US005377665A

United States Patent [19]

Jang

[11] Patent Number: 5,377,665

[45] Date of Patent: Jan. 3, 1995

[54] EXTERNAL BODY OF KITCHEN FUME EXTRACTOR

[76] Inventor: Sun-Sing Jang, 650, Yuan-Huan E. Rd., Fong-Yuan, Taichung Hsien, Taiwan, Prov. of China

[21] Appl. No.: 7,283

[22] Filed: Jan. 21, 1993

[51] Int. Cl.[6] ..... F24C 15/20

[52] U.S. Cl. ..... 126/299 R; 126/299 D

[58] Field of Search ..... 126/299 R, 299 F, 299 D, 126/299 E, 299 L; 403/405.1, 337, 274

[56] References Cited

U.S. PATENT DOCUMENTS 1,802,617 4/1931 Mullin et al. ..... 126/299 R 2,348,366 5/1944 Saviskas ..... 126/299 R 4,011,802 3/1977 Molitor ..... 126/299 R

*Primary Examiner*—Larry Jones

*Attorney, Agent, or Firm*—Browdy and Neimark

[57] ABSTRACT

A external body of a kitchen fume extractor comprising a top sheet member having left and right edges extending downwardly to form a short plate portion extending inwardly to form a first fixing portion, two side sheet members individually having a second fixing portion extending inwardly from the upper edge of the side sheet member and secured to the first fixing portion, and a rear sheet member attached to the top sheet member and the side sheet members.

10 Claims, 4 Drawing Sheets

EXTERNAL BODY OF KITCHEN FUME EXTRACTOR

BACKGROUND OF THE INVENTION

The present invention retates generally to a kitchen smoke or fume extractor or hood, and more particularly relates to an external body for such an extractor.

FIGS. 1–3 of the accompanying drawings illustrate the external body of a conventional kitchen fume extractor. The body 10 comprises a top sheet 11, a left sheet 12, a right sheet 13 and a rear sheet 14. Both the left and right sheets 12, 13 are provided with projecting flanges 121, 131 around their edges. In the process of assembling the various sheets to form the body 10, both the left and right sheets 12, 13 are united with the top sheet 11 by fitting the projecting flanges 121, 131 over the left and right edges 111, 112 of the top sheet 11. The left and right sheets 12, 13 are fastened securely to the top sheet 11 by spot welding.

The body of such a kitchen extractor suffers from the following disadvantages, that is, because the sheets 11, 12, 13 and 14 are made of thin stainless steel sheet by means of punching and pressing, both the external edges 122, 132 of the projecting flanges 121, 131 of the left and right sheets 12, 13 are very sharp, rather like a blade, which is often a potential hazard. Hence, when a person is transporting or cleaning the body 10, his hand may be injured by the edges 122, 133.

SUMMARY OF THE INVENTION

An object of the present invention is to provide an external body for a kitchen fume extractor having an improved structure effectively devoid of the previously mentioned sharp edges, which are capable of inflicting an injury on persons assembling, transporting or cleaning the extractor.

According to the present invention, an external body of a kitchen fume extractor comprising a top sheet member having left and right edges extending downwardly to form a short plate portion and then extending inwardly to form a first fixing portion, two side sheet members individually having a second fixing portion extending inwardly from the upper edge of the side sheet member and secured to the first fixing portion, and a rear sheet member attached to the top sheet member and the side sheet members.

The present invention may best be understood through the following description with reference to the accompanying drawings, in which:

DETAILED DESCRIPTION OF THE PREFERRED EMBODIMENTS

Figure 1:
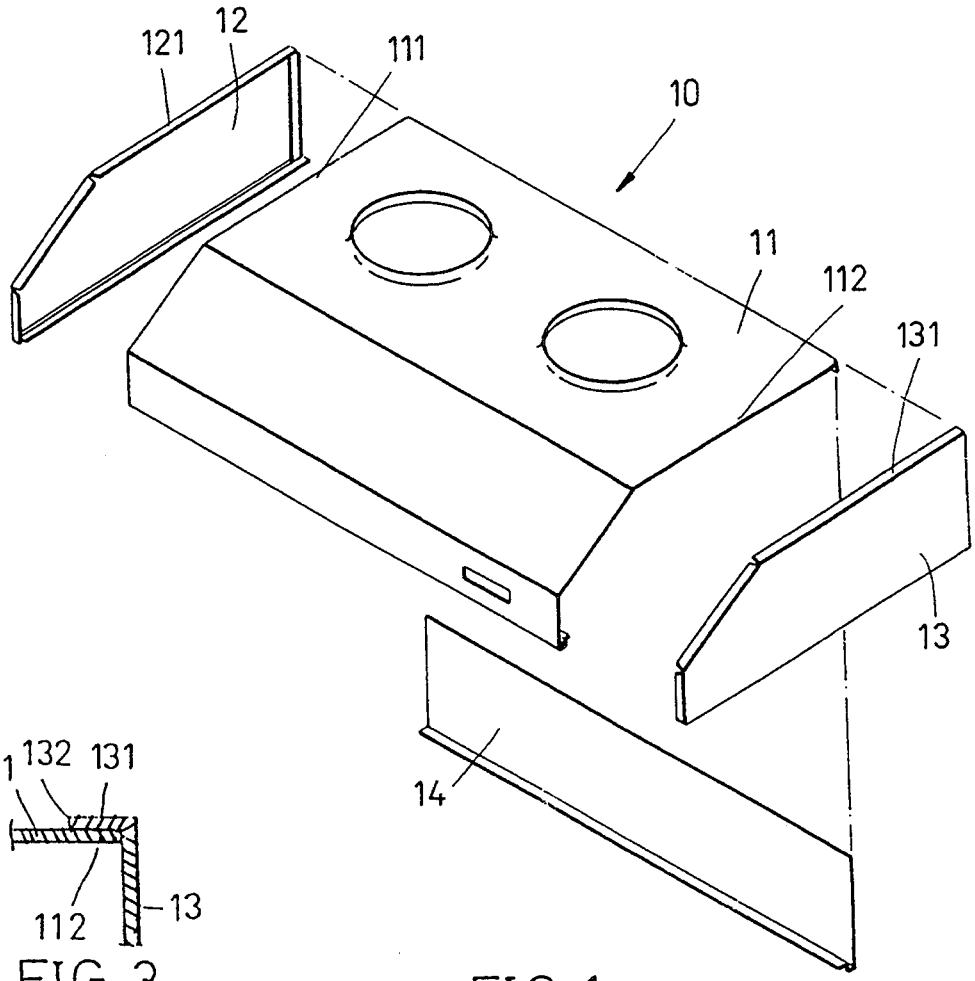
FIG. 1 (PRIOR ART)
FIG. 1 is an exploded schematic view of the external body of a conventional extractor.
Figure 3:
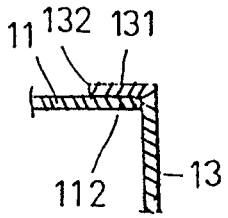
FIG. 3 (PRIOR ART)
FIG. 3 is an enlarged fragmentary sectional view taken along the line 3—3 in FIG. 2.
Figure 2:
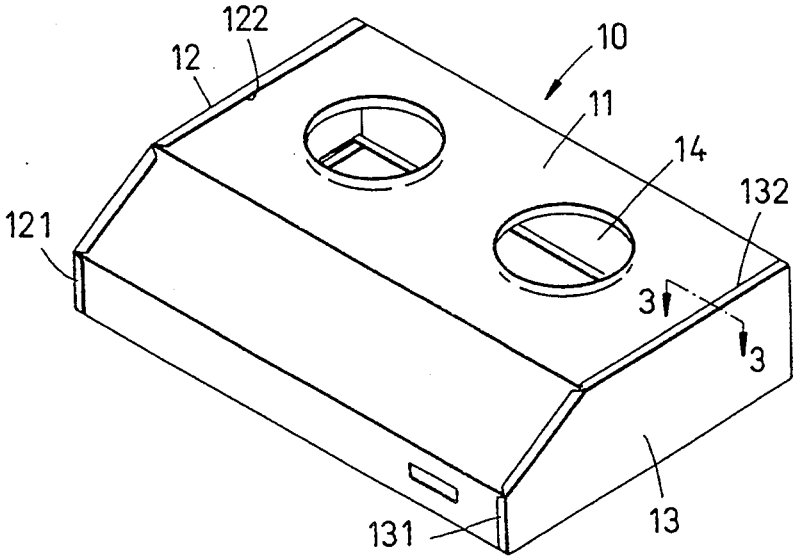
FIG. 2 (PRIOR ART)
FIG. 2 is a perspecting view showing the body of FIG. 1 after assembly.
Figure 4:
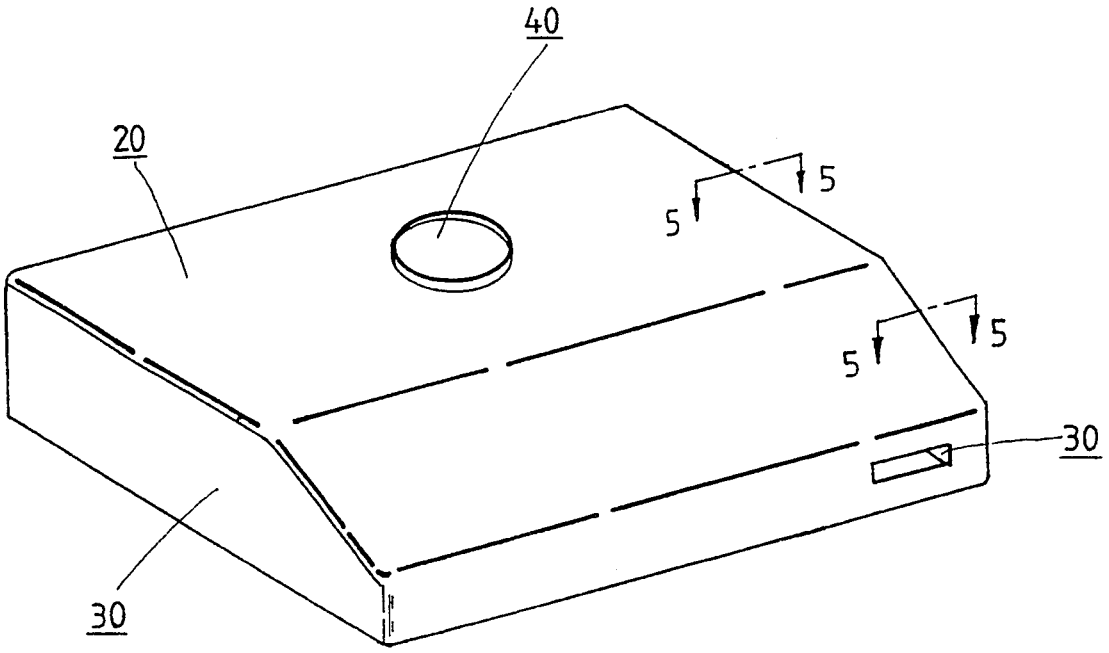
FIG. 4 is a perspective view showing an assembled body of the present invention.

Referring now to FIG. 4, an external body of a kitchen fume extractor according to the present invention includes a top sheet member 20, two side sheet member 30 and a rear sheet member 40.

Figure 5:
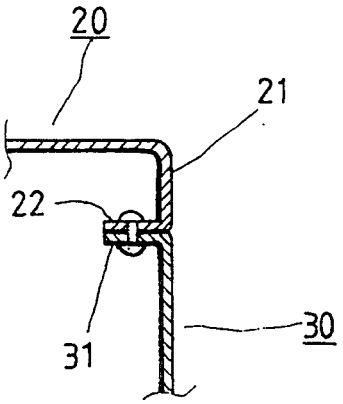
FIG. 5 is a sectional view taken along the line 5—5 of FIG. 8, showing a first preferred embodiment according to the present invention.

FIG. 5 shows a first embodiment of the present invention, in which the top sheet member having left and right edges extending downwardly to form a short plate portion 21. The bottom edge of the short plate portion extending inwardly to form a first fixing portion 22. The side sheet member 30 having a second fixing portion 31 extending inwardly from it's upper edge. Thereafter, the first and second fixing portion 22, 31 are securely fastened by means of spot welding, screws, rivets, or the like.

The external body of a kitchen fume extractor embodying the present invention has the following advantage over the prior art, that is, the edges of the top sheet and side sheets are united in such a unique manner that there are effectively no exposed edges which may cause accidental injury to an assembly worker or a person cleaning the body.

Figure 6:
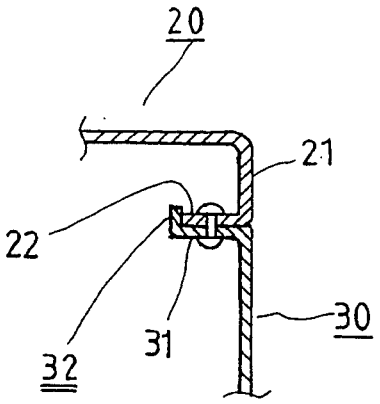
FIG. 6 is a schematic view of the structural features of a second embodiment of the present invention.

A second embodiment of the present invention is shown in FIG. 6, in which the outter edge of the second fixing portion 31 extending upwardly to form a resisting portion 32. In the process of assembling the external body of this embodiment, the first fixing portion 22 is kept close to the second fixing portion 31, and is positioned on the resisting portion 32. Thereafter, the first and second fixing portion 22, 31 are securely fastened together.

Figure 7:
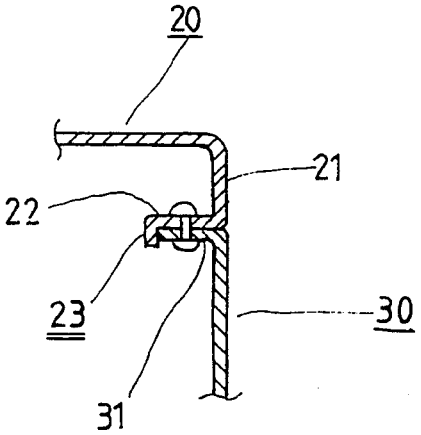
FIG. 7 is a schematic view of the structural features of a third embodiment of the present invention.

As shown in FIG. 7, the third embodiment of the present invention differs from the first embodiment in that the outer edge of the first fixing portion 22 extending downwardly to form a resisting portion 23, which resists the outer edge of the second fixing portion 31.

Figure 8:
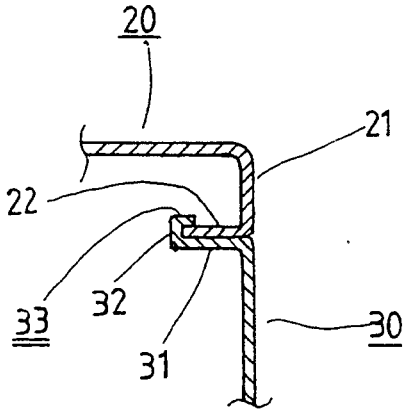
FIG. 8 is a schematic view of the structural features of a fourth embodiment of the present invention.

A fourth preferred embodiment of the invention as show in FIG. 8, is similar to the second preferred embodiment. The distinction is that the upper edge of the resisting portion 32 is additionally bent outwardly to form a strip portion 33. So as to form a receiving channel among the second fixing portion 31, the resisting portion 32 and the strip portion 33. The first fixing portion 22 is closely integrated with the associated receiving channels of the side sheet members 30.

Figure 9:
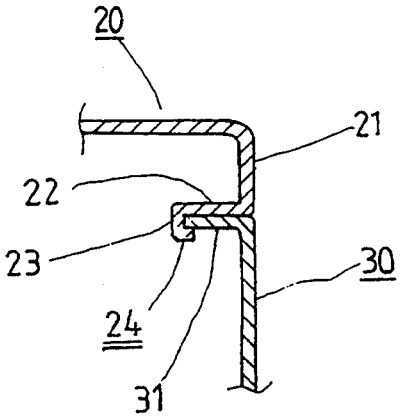
FIG. 9 is a schematic view of the structural features of a fifth embodiment of the present invention.

A fifth preferred embodiment of the present invention as show in FIG. 9, is similar to the third preferred embodiment. The difference is that the bottom edge of the resisting portion 23 is additionally bent outwardly to form a strip portion 24. So as to form a receiving channel among the first fixing portion 22, the resisting portion 23 and the strip portion 24. The second fixing portion 31 is closely integrated with the associated receiving channels of the side sheet members 30.

Figure 10:
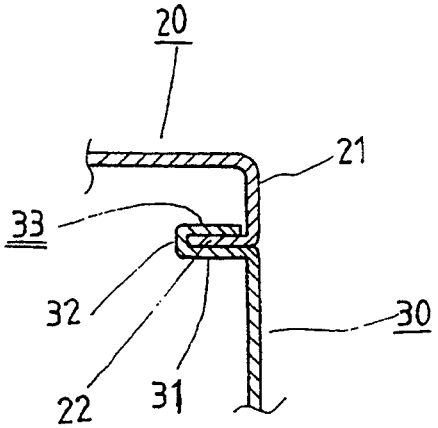
FIG. 10 is a schematic view of the structural features of a sixth embodiment of the present invention.

As shown in FIG. 10, the sixth preferred embodiment of the present invention differs from the fourth embodiment in that the width of the strip portion 33 is longer than the fourth embodiment. The ending edge of the strip portion 33 is very near the internal surface of the short plate portion 21. Thereafter, the first fixing portion 22, the second fixing portion 31 and the strip portion 33 are held mechanically locked together by means of a pressing or forming device.

Figure 11:
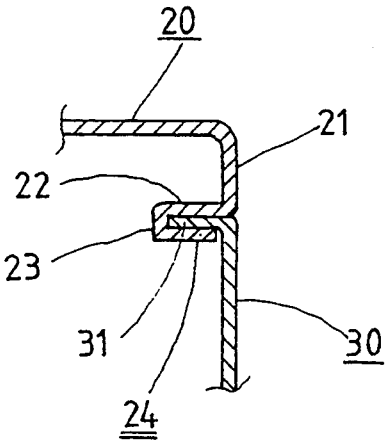
FIG. 11 is a schematic view of the structural features of a seventh embodiment of the present invention.

As shown in FIG. 11, the seventh preferred embodiment of the present invention differs from the fifth embodiment in that the width of the strip portion 24 is longer than the fifth embodiment. The ending edge of the strip portion is very near the internal surface of the side sheet members 30. Thereafter, the second fixing portion 31, the first fixing portion 22 and the strip portion 24 are held mechanically locked together by means of a pressing or forming device.

Figure 12:
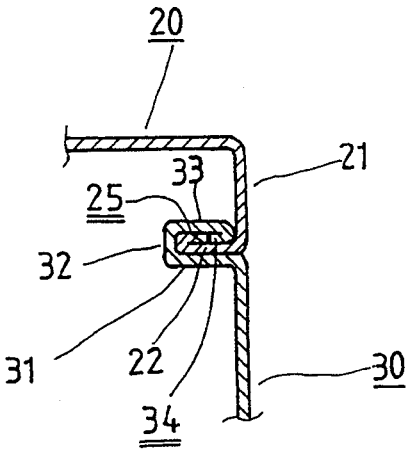
FIG. 12 is a schematic view of the structural features of an eighth embodiment of the present invention.

FIG. 12 shows an eighth embodiment of the present invention differing from the sixth embodiment shown in FIG. 10 in that the width of the receiving channel is more wide than the sixth embodiment. The ending edge of the strip portion 33 is bent downwardly and then inwardly through 180 degrees so as form a first basic strip 34. The ending edge of the first fixing portion 22 is bent upwardly and then outwardly through 180 degrees so as to form a second basic strip 25. The first fixing portion 22 is then inserted into the receiving channel of the side sheet members 30, and the top sheet member 20 and the side sheet members 30 are held mechanically locked together in an unique manner. That is, the ending edge of the second basic strip 25 engages the ending edge of the first basic strip 34. Thus, this embodiment needs no welding.

Figure 13:
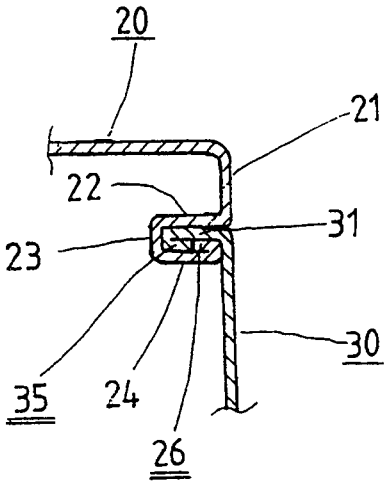
FIG. 13 is a schematic view of the structural features of a ninth embodiment of the present invention.

FIG. 13 shows a ninth embodiment of the present invention differing from the seventh embodiment shown in FIG. 11 in that the width of the receiving channel is more wide than the seventh embodiment. The ending edge of the strip portion 24 is bent upwardly and then inwardly through 180 degrees so as to form a third basic strip 26. The ending edge of the second fixing portion 31 is bent downwardly and then outwardly through 180 degrees so as to from a fourth basic strip 35. The second fixing portion 31 is inserted into the receiving channel of the top sheet member 20. Thereafter, the ending edge of the fourth basic strip 35 engages the ending edge of the third basic strip 26.

Figure 14:
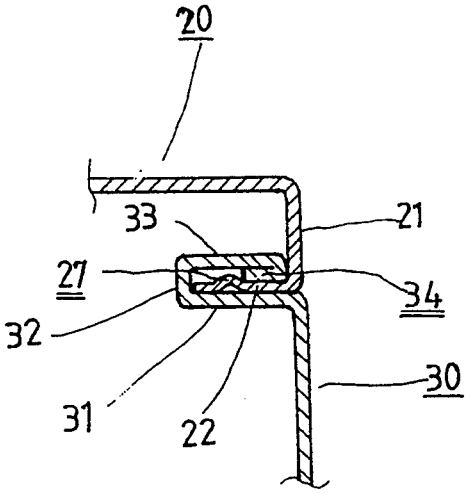
FIG. 14 is a schematic view of the structural features of a tenth embodiment of the present invention.

A tenth preferred embodiment of the present invention, as shown in FIG. 14, differs from the embodiment shown in FIG. 12 that the outter section of the first fixing portion 22 projects upwardly a plurality of protruding portions 27 which resist the ending edge of the first basic strip 34, instead of the second basic strip 25 of the eighth embodiment.

Figure 15:
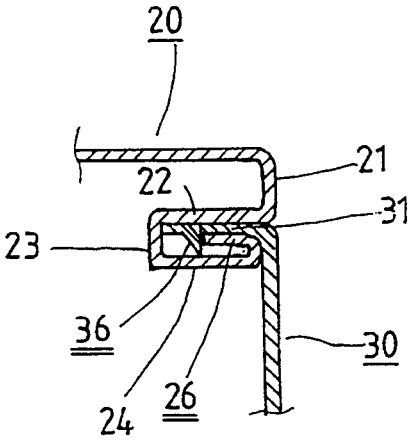
FIG. 15 is a schematic view of the structural features of a eleventh embodiment of the present invention.

A eleventh preferred embodiment of the present invention, as shown in FIG. 15, differs from the embodiment shown in FIG. 13 in that the outer section of the second fixing portion 31 projects downwardly a plurality of protruding portions 36 which resist the ending edge of the third basic strip 26, instead of the fourth basic strip 35 of the ninth embodiment.

While the invention has been described in connection with what is presently considered to be the most practical and preferred embodiments, it is to be understood that the invention is not to be limited to the disclosed embodiments out on the contrary, is intended to cover various modifications and equivalent arrangements included within the spirit and scope of the appended claims which scope is to be accorded the broadest interpretation so as to encompass all such modifications and equivalent structures.

What I claim is:

1. A external body of kitchen fume extractor comprising:

a top sheet member having left and right edges extending downwardly to form a plate portion and then extending inwardly to form a first fixing portion;

two side sheet members individually having a second fixing portion extending inwardly from an upper edge of each of said side sheet members; said first fixing portion and said second fixing portion having a free end, protection and joining means engaged over each said free end for engaging said first fixing portion to said second fixing portion and covering edges on each said free end, a rear sheet member attached to said top sheet member and said side sheet members;

wherein said protection and joining means comprises an outer edge extending upwardly from said free end of said second fixing portion so as to form a resisting portion which engages said free end of said first fixing portion, and wherein an upper edge of said resisting portion extends outwardly to form a strip portion, forming a channel with said second fixing portion to receive said first fixing portion, wherein the ending edge of said strip portion is near the internal surface of said side sheet members and wherein said plate portion and one side sheet member of said side sheets are in a same plane.

2. A external body of a kitchen fume extractor according to claim 1, where said first fixing portion, said second fixing portion and said strip portion are held together by mechanical pressing.

3. A external body of a kitchen fume extractor according to claim 1, wherein said first and second fixing portion are securely fastened by means of screws.

4. A external body of a kitchen fume extractor according to claim 1, wherein said first and second fixing portion are securely fastened by means of rivets.

5. A external body of a kitchen fume extractor according to claim 1, wherein said resisting portion is longer than a thickness of said first fixing portion, and the ending edge of said strip portion is bent downwardly and then inwardly through 180 degrees so as to form a first basic strip, and the outer section of said first fixing portion projects upwardly into a protruding portion which engages the ending edge of said first basic strip.

6. A external body of kitchen fume extractor comprising:

a top sheet member having left and right edges extending downwardly to form a plate portion and then extending inwardly to form a first fixing portion;

two side sheet members individually having a second fixing portion extending inwardly from an upper edge of each of said side sheet members; said first fixing portion and said second fixing portion having a free end, protection and joining means engaged over each said free end for engaging said first fixing portion to said second fixing portion and covering edges on each said free end and a rear sheet member attached to said top sheet member and said side sheet members;

wherein said protection and joining means comprises an outer edge extending downwardly from said free end of said first fixing portion so as to form a resisting portion which engages said free end of said second fixing portion, wherein an upper edge of said resisting portion extends outwardly to form a strip portion, forming a channel with said first fixing portion to receive said second fixing portion wherein the ending edge of said strip portion is near the internal surface of said side sheet members and wherein said plate portion and one side sheet member of said side sheets are in a same plane.

7. A external body of a kitchen fume extractor according to claim 6, where said second fixing portion, said first fixing portion and said strip portion are held together by mechanical pressing.

8. A external body of a kitchen fume extractor according to claim 6, wherein said resisting portion is longer than a thickness of said first fixing portion, and the ending edge of said strip portion is bent downwardly and then inwardly through 180 degrees so as to form a first basic strip, and the outer section of said first fixing portion projects upwardly into a protruding portion which engages the ending edge of said first basic strip.

9. A external body of kitchen fume extractor comprising:

a top sheet member having left and right edges extending downwardly to form a plate portion and then extending inwardly to form a first fixing portion;

two side sheet members individually having a second fixing portion extending inwardly from an upper edge of each of said side sheet members; said first fixing portion and said second fixing portion having a free end, protection and joining means engaged over each said free end for engaging said first fixing portion to said second fixing portion and covering edges on each said free end, a rear sheet member attached to said top sheet member and said side sheet members, wherein said protection and joining means comprises an outer edge extending upwardly from said free end of said second fixing portion so as to form a resisting portion, wherein an upper edge of said resisting portion extends outwardly to form a strip portion forming a channel with said second fixing portion to receive said first fixing portion, wherein an ending edge of said strip portion is near the internal surface of said plate portion of said top sheet member, wherein said resisting portion is longer than a thickness of said first fixing portion, and the ending edge of said strip portion is bent downwardly and then inwardly through 180 degrees so as to form a first basic strip, and an ending edge of said first fixing portion is bent upwardly and then outwardly through 180 degrees so as to form a second basic strip which has an ending edge which engages to the ending edge of said first basic strip and wherein said plate portion and one side sheet member of said side sheets are in a same plane.

10. A external body of kitchen fume extractor comprising:

a top sheet member having left and right edges extending downwardly to form a plate portion and then extending inwardly to form a first fixing portion;

two side sheet members individually having a second fixing portion extending inwardly from an upper edge of each of said side sheet member; said first fixing portion and said second fixing portion having a free end, protection and joining means engaged over each said free end for engaging said first fixing portion to said second fixing portion and covering edges on each said free end, a rear sheet member attached to said top sheet member and said side sheet members, wherein said protection and joining means comprises an outer edge extending downwardly from said free end of said second fixing portion so as to form a resisting portion, wherein an upper edge of said resisting portion extends outwardly to form a strip portion forming a channel with said second fixing portion to receive said first fixing portion, wherein an ending edge of said strip portion is near the internal surface of said plate portion of said top sheet member, wherein said resisting portion is longer than a thickness of said second fixing portion, and the ending edge of said strip portion is bent upwardly and inwardly through 180 degrees so as to form a third basic strip, and the ending edge of said second fixing portion is bent downwardly and then outwardly through 180 degrees so as to form a fourth basic strip which has an ending edge which engages the ending edge of said third basic strip and wherein said plate portion and one side sheet member of said side sheets are in a same plane.

* * * * *